US010118672B2

(12) United States Patent
Fitch

(10) Patent No.: US 10,118,672 B2
(45) Date of Patent: Nov. 6, 2018

(54) ANCHOR

(71) Applicant: FE ANCHOR CORPORATION, Victoria (SC)

(72) Inventor: Edmund Fitch, Lewes (GB)

(73) Assignee: FE ANCHOR CORPORATION, Victoria (SC)

( * ) Notice: Subject to any disclaimer, the term of this patent is extended or adjusted under 35 U.S.C. 154(b) by 0 days.

(21) Appl. No.: 15/111,405

(22) PCT Filed: Jan. 15, 2015

(86) PCT No.: PCT/GB2015/050071
§ 371 (c)(1),
(2) Date: Jul. 13, 2016

(87) PCT Pub. No.: WO2015/107345
PCT Pub. Date: Jul. 23, 2015

(65) Prior Publication Data

US 2016/0347420 A1 Dec. 1, 2016

(30) Foreign Application Priority Data

Jan. 15, 2014 (GB) ..... 1400649.8

(51) Int. Cl.
*B63B 21/38* (2006.01)
*B63B 21/40* (2006.01)
*B63B 21/24* (2006.01)

(52) U.S. Cl.
CPC ..... *B63B 21/40* (2013.01); *B63B 2021/246* (2013.01)

(58) Field of Classification Search
CPC ..... B63B 21/40
See application file for complete search history.

(56) References Cited

U.S. PATENT DOCUMENTS 2,413,596 A 12/1946 Wood, Jr.
2,797,658 A * 7/1957 Doty, Jr. ..... B63B 21/243 114/298
4,098,216 A 7/1978 Bruce
4,230,062 A 10/1980 Fornasiero
4,380,207 A * 4/1983 Nolt ..... B63B 21/44 114/297

(Continued)

FOREIGN PATENT DOCUMENTS

CN 86100338 8/1987
DE 8518936 8/1985

(Continued)

OTHER PUBLICATIONS

International Search Report and Written Opinion prepared by the European Patent Office dated Apr. 28, 2015, for International Application No. PCT/GB2015/050071.

(Continued)

*Primary Examiner* — Stephen P Avila
(74) *Attorney, Agent, or Firm* — Sheridan Ross PC

(57) ABSTRACT

An anchor (1) comprises a fluke (2) and a shank (3) pivotally connected to one another. The shank (3) is pivotable between an anchor deployment configuration and an anchor retrieval configuration, and a fastener 36 is provided to engage with the shank 3 to retain the shank (3) in the anchor retrieval configuration.

20 Claims, 9 Drawing Sheets

(56) References Cited

U.S. PATENT DOCUMENTS

| | | | | |
|---|---|---|---|---|
| 4,724,789 | A | 2/1988 | van den Haak | |
| 4,869,193 | A | 9/1989 | van den Haak | |
| 5,095,842 | A * | 3/1992 | Soules | B63B 21/243 114/210 |
| 5,542,368 | A * | 8/1996 | Yoshioka | B63B 21/46 114/294 |
| 5,890,451 | A * | 4/1999 | Bruce | B63B 21/26 114/297 |
| 6,148,758 | A * | 11/2000 | Wilkins | B63B 21/40 114/301 |
| 9,061,741 | B2 | 6/2015 | Fitch | |
| 2015/0336638 | A1 | 11/2015 | Fitch | |

FOREIGN PATENT DOCUMENTS

| | | |
|---|---|---|
| EP | 0049544 | 4/1982 |
| EP | 0220758 | 5/1987 |
| GB | 2174055 | 10/1986 |
| JP | S62-110591 | 5/1987 |
| JP | S64-22696 | 2/1989 |
| JP | 3183202 | 5/2013 |
| WO | WO 83/00126 | 1/1983 |
| WO | WO 96/39324 A1 | 12/1996 |
| WO | WO 98/38080 | 9/1998 |
| WO | WO 01/81161 | 11/2001 |
| WO | WO 2007/107699 | 9/2007 |
| WO | WO 2010/116147 | 10/2010 |
| WO | WO 2013/133695 A1 | 9/2013 |

OTHER PUBLICATIONS

International Preliminary Report on Patentability (Chapter II of the PCT) prepared by the European Patent Office dated Nov. 4, 2015, for International Application No. PCT/GB2015/050071.

International Search Report and Written Opinion prepared by the European Patent Office dated Nov. 17, 2010, for International Application No. PCT/GB2010/000719.

Official Action for U.S. Appl. No. 13/263,288 dated Nov. 22, 2013 10 pages.

Official Action for U.S. Appl. No. 13/263,288, dated Jun. 26, 2014 9 pages.

Notice of Allowance for U.S. Appl. No. 13/263,288, dated Feb. 17, 2015 7 pages.

Official Action for U.S. Appl. No. 14/719,123, dated Aug. 12, 2016 8 pages.

Notice of Allowance for U.S. Appl. No. 14/719,123, dated May 3, 2017 9 pages.

Corrected Notice of Allowance for U.S. Appl. No. 14/719,123, dated May 19, 2017 5 pages.

Official Action for European Patent Application No. 15705355.4, dated May 16, 2018, 5 pages.

* cited by examiner

ANCHOR

CROSS REFERENCE TO RELATED APPLICATIONS

This application is a national stage application under 35 U.S.C. 371 and claims the benefit of PCT Application No. PCT/GB2015/050071 having an international filing date of 15 Jan. 2015, which designated the United States, which PCT application claimed the benefit of Great Britain Application No. 1400649.8 filed 15 Jan. 2014, the disclosure of both the above-identified applications are incorporated herein by reference.

TECHNICAL FIELD

The present disclosure relates to an anchor. The disclosure is particularly, but not exclusively, applicable to an anchor that is used to moor a first vessel but is deployed and retrieved from a second vessel, as common, for example, with oil and gas rigs supported by dedicated anchoring vessels.

BACKGROUND

A large number of different types of anchors have been proposed for mooring vessels, and various improvements have been suggested for the types of anchors commonly in use. Designs and improvements have typically been directed to aims such as increasing the water depth in which anchoring can be carried out, increasing strength, increasing manoeuvrability and increasing efficiency, that is maximum weight of a vessel that can be anchored with an anchor of given weight.

A shovel or plough like part of an anchor that digs itself into the ground to secure the anchor in position is generally known as a fluke, and a body of an anchor to which a chain is usually secured from the vessel is generally known as a shank. In some anchors the fluke is pivotally connected to the shank so that the angle between the fluke and shank can increase as the fluke buries itself into the seabed. Other anchors have a fluke that is rigidly connected to a shank to improve strength or for use in particular types of ground. These are generally known as fixed fluke anchors.

One problem with conventional fixed fluke anchors that has not been adequately addressed to date is reliably setting an anchor so that the anchor is correctly orientated when deployed, remains in place and is retrievable when desired with the minimum of delay and without the anchor getting snagged or stuck in the ground. Retrieval may be particularly problematic when a vessel is moored in very deep water, when the anchor has been deployed for a considerable length of time, if the bottom is heavy, with sticky clay for example, if the anchor has sunk through many layers of silt and mud and then become embedded in a heavier deposit or where the anchor is especially large and heavy. These issues may arise in particular when anchoring the kinds of large scale semisubmersible vessels or drill ships used for offshore exploration and well servicing, which is done with the aid of separate anchor handling vessels, using massive anchors and may require multiple anchors.

SUMMARY

According to one aspect of the disclosure, there is provided an anchor comprising: a fluke; a shank pivotally connected to the fluke so as to pivot between an anchor deployment configuration and an anchor retrieval configuration; and a fastener arranged to engage with the shank to retain the shank in the anchor retrieval configuration.

Retaining the shank in the anchor retrieval configuration may allow improved ease of retrieval of the anchor from the ground. For example, the shank may be prevented from pivoting from the anchor retrieval configuration to a position relative to the fluke in which the fluke has a greater profile in the direction that the anchor is being retrieved, which is typically along the main axis of the shank. This may make it easier to extract the anchor from the ground. It can also reduce the chances of the anchor snagging on other objects as it is lifted from the ground, and spinning as it is pulled through the water. The fastener may be a catch. That is, it may be a device that both captures and retains the shank at once. The catch may operate independently to capture and retain the shank, thus allowing the shank to be retained in the anchor retrieval configuration simply by pivoting the shank into that configuration.

In one example, the fastener has a projection that extends over a lip of the shank to engage with the shank to retain the shank in the anchor retrieval configuration. Advantageously, the fastener may be biased towards engagement with the shank. This may improve the reliability of the retaining. In one example, the fastener has a cam surface, the shank has a cam follower, and the cam follower is arranged to cooperate with the cam surface as the shank pivots to the anchor retrieval configuration so as to push the fastener against the biasing until the fastener engages with the shank.

The fastener may have an actuator that is moveable to release the fastener from engagement with the shank to allow the shank to pivot to the anchor deployment configuration. Advantageously, the actuator may protrude from a surface of the fluke and be operable where it protrudes to release the fastener from engagement with the shank. The actuator may operable to release the fastener from engagement with the shank by being moved towards the surface. This may allow the actuator to be operated automatically as the anchor is retrieved over the side of a vessel. The actuator may be biased away from the surface. This may help to ensure that the actuator is prominent and hence operated more easily.

In one example, the actuator is on the opposite side of the fluke to the shank. This means that the actuator may be on the side of the fluke that is more likely to be the bottom side whilst the anchor is being retrieved, improving the reliability with which the actuator may be operated automatically as the anchor is retrieved over the side of the vessel.

In one particularly preferred example, the fastener may comprise a rocker arm, the engagement of the fastener with the shank occurring at one end of the rocker arm and the actuator being the other end of the rocker arm.

The fluke may have a head and a bill, and the shank may be pivotally connected to the fluke around an axis located such that more of the profile of the fluke is between the axis and the head than between the axis and the bill. When the anchor is in the ground, this may have the effect of causing the torque applied to the fluke about the axis to urge the shank towards the bill. This may help to ensure that the anchor remains in the anchor deployment configuration.

The anchor typically has a brace that restricts pivoting of the shank to provide the anchor deployment configuration. The brace may be moveable between a bracing position when the anchor is in the anchor deployment configuration and a stowed position when the anchor is in the anchor retrieval configuration.

In one example, the brace is pivotally connected at one end to the fluke and pivotally connected at the other end to the shank, and the brace is articulated so as to fold between the bracing position and the stowed position.

Usually, the brace is retained in the bracing position by a frangible retainer.

It is preferred that the anchor has two or more different anchor deployment configurations, the shank being oriented at a different angle to the fluke in each of the anchor deployment configurations. In one example, the anchor has a stop against which the brace rests in the bracing position, which stop can be positioned in one of at least two different locations, each different location providing a different bracing position, each different bracing position causing the shank to be oriented at a different angle to the fluke in the anchor deployment configuration.

The anchor may be provided with a return member operable to cause the shank to pivot away from the anchor retrieval configuration. The anchor may be provided with a biasing member that biases the shank to pivot away from the anchor retrieval configuration. The return member or the biasing member may help in returning the anchor from the anchor retrieval position to the anchor deployment configuration.

Embodiments of the disclosure are described below, by way of example only, with reference to the accompanying drawings.

DETAILED DESCRIPTION

Figure 1:
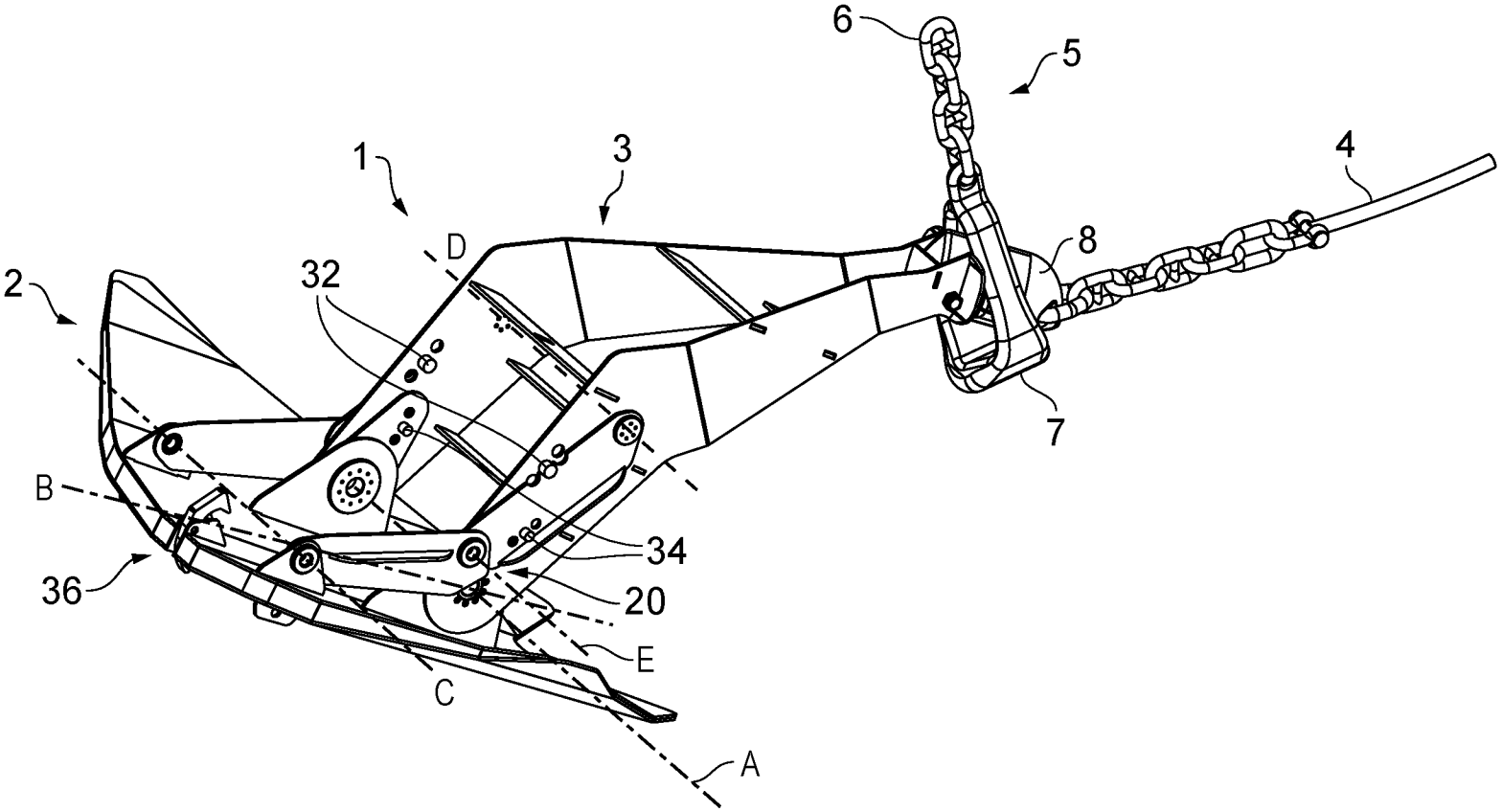
FIG. 1 is a perspective view of an anchor according to a first embodiment.
Figure 2:
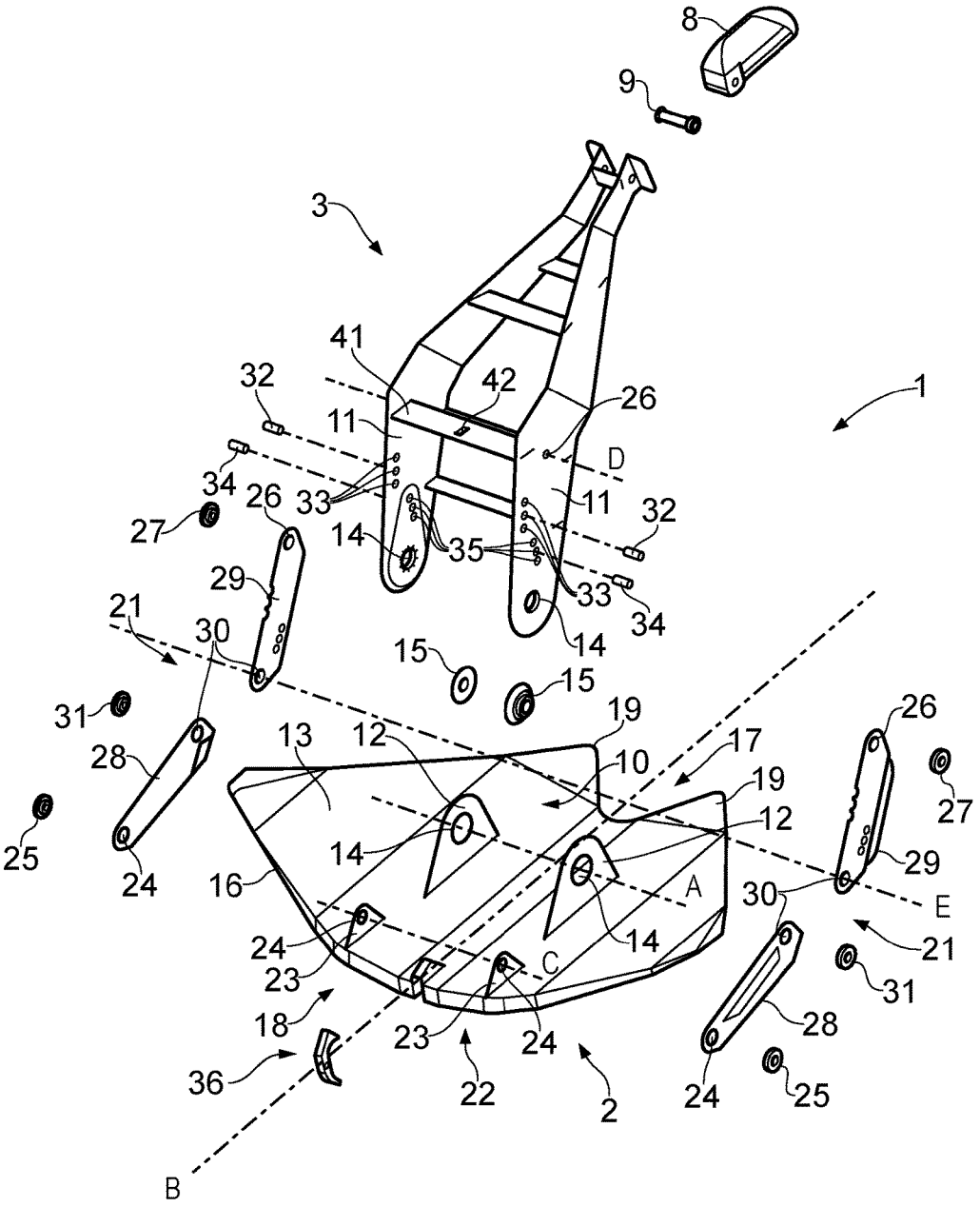
FIG. 2 is an exploded perspective view the anchor.

Referring to FIGS. 1 and 2, an anchor 1 according to a first embodiment comprises a fluke 2 and a shank 3. The anchor 1 is used to anchor a vessel (not shown) via a mooring line 4. The anchor 1 is handled by an anchor handling tug supply vessel (AHTS vessel) (not shown), which uses a chaser 5 to control the anchor 1. The chaser 5 comprises a chasing line 6 attached to a chasing collar 7 that surrounds the mooring line 4. More precisely, in this embodiment, a shackle 8 used to attach the mooring line 4 to the anchor 1, via a pin 9, and the chasing collar 7 are of the type described in patent publication WO2010/116147, the content of which is incorporated herein by reference, whereby the chasing collar 7 can cooperate with the shackle 8 to lock the orientation of the anchor 1 with respect to the chasing line 6.

The shank 3 is pivotally connected to the fluke 2. More specifically, the fluke 2 has a shank bracket 10 that cooperates with a first end of the shank 3 to connect the shank 3 and fluke 2 pivotally. In this embodiment, the shank 3 comprises two shank arms 11 that are side by side but spaced apart from one another. The shank bracket 10 comprises two shank supports 12 that protrude from a first surface 13 of the fluke 2, spaced apart from one another so as to coincide with the shank arms 11 at the first end of the shank 3. A first of the shank supports 12 coincides with a first of the shank arms 11 at the first end of the shank 3 and a second of the shank supports 12 coincides with a second of the shank arms 11 at the first end of the shank 3. Each of the shank supports 12 and the shank arms 11 has a hole 14 centred on a first axis of rotation A between the fluke 2 and shank 3. Two studs 15 are provided, one inserted in the holes 14 of the first of the shank supports 12 and the first of the shank arms 11 and one inserted in the holes 14 of the second of the shank supports 12 and the second of the shank arms 11. The studs 15 rotate in the holes 14 to allow the shank arms 11 to rotate relative to the shank supports 12, and hence the shank 3 to rotate relative to the fluke 2, about the first axis of rotation A. It will be appreciated that the fluke 2 and shank 3 can pivot relative to one another around the first axis of rotation A, but not in other directions, meaning that the joint between the shank 3 and the fluke 2 can be described as a hinge, or a hinged joint, and the pivoting between the shank 3 and the fluke 2 can be described as rotation.

The fluke 2 comprises a plate 16 in the form of a shovel or spade. More specifically, the plate 16 is curved so as to coincide roughly with a portion of a wall of an imaginary cylinder having an axis of curvature perpendicular to the axis of rotation A between the shank 3 and the fluke 2. At least, the fluke 2 is symmetric about an axis of symmetry B perpendicular to the axis of rotation A between the shank 3 and the fluke 2, even if the curvature may deviate a little from the surface of the imaginary cylinder with increasing distance from the axis of symmetry B, and possibly also with distance along the axis of symmetry B. A bill 17 of the fluke 2 is at an edge of the plate 16 towards one end of the axis of symmetry B and a head 18 of the fluke 3 is at an edge of the plate 16 towards the other end of the axis of symmetry B. The bill 17 has two tips 19 that are relatively thin or sharp in comparison to the rest of the perimeter of the plate 16. The bill 17 helps the fluke 2 dig into the ground. The portions of the plate 16 on either side of the axis of symmetry B may be referred to as wings.

Because the axis of rotation A between the shank 3 and the fluke 2 is perpendicular to the line of symmetry B running between the bill 17 and the head 18 of the fluke 2, it will be appreciated that the shank 3 can pivot between the bill 17 of the fluke 2 and the head 18 of the fluke 2.

A brace 20 is provided to restrict pivoting of the shank 3 towards to the bill 17 of the fluke 2. In this embodiment, the brace 20 comprises two brace arms 21 extending from the two shank arms 11 to the fluke 2. A first of the brace arms 21 extends from the first of the shank arms 11 to the fluke 2 and a second of the brace arms 21 extends from the second of the shank arms 11 to the fluke 2.

The brace 20 is pivotally connected to the fluke 2 close to the head 18 of the fluke 2. The fluke 2 has a brace bracket 22 that cooperates with a fluke end of the brace 20 to connect the fluke 2 and the brace 20 pivotally. The brace bracket 22 comprises two brace supports 23 that protrude from the first surface 13 of the fluke 2, spaced apart from one another so as to coincide with the brace arms 21 at the fluke end of the brace 20. A first of the brace supports 23 coincides with the first of the brace arms 21 at the fluke end of the brace 20 and a second of the brace supports 23 coincides with the second of the brace arms 21 at the fluke end of the brace 20. Each of the brace supports 23 and the brace arms 21 has a hole 24 centred on a second axis of rotation C between the fluke 2 and brace 20. Two studs 25 are provided, one inserted in the holes 24 of the first of the brace supports 23 and the first of the brace arms 21 and another inserted in the holes 24 of the second of the brace supports 23 and the second of the brace arms 21. The studs 25 rotate in the holes 24 to allow the brace arms 21 to rotate relative to the brace supports 23, and hence the brace 20 to rotate relative to the fluke 2, about the second axis of rotation C.

The brace 20 is also pivotally connected to the shank 3. The shank 3 cooperates with a shank end of the brace 20 to connect the shank 3 and the brace 20 pivotally. The brace arms 21 are spaced apart from one another so as to coincide with the shank arms 11 at the shank end of the brace 20. The first of the brace arms 21 coincides with the first of the shank arms 11 at the shank end of the brace 20 and the second of the brace arms 21 coincides with the second of the shank arms 11 at the shank end of the brace 20. Each of the brace arms 21 and the shank arms 11 has a hole 26 centred on a third axis of rotation D between the brace 20 and the shank 2. Two studs 27 are provided, one inserted in the holes 26 of the first of the brace arms 21 and the first of the shank arms 11 and another inserted in the holes 26 of the second of the brace arms 21 and the second of the shank arms 11. The studs 27 rotate in the holes 26 to allow the brace arms 21 to rotate relative to the shank arms 11, and hence the brace 20 to rotate relative to the shank 3, about the third axis of rotation D.

The brace 20 is articulated. That is, the brace 20 has a pivoting joint along its length, between the fluke end and the shank end. In this embodiment, since the brace 20 comprises two brace arms 21, each of the brace arms 21 comprises two members 28, 29: a first member 28 towards the fluke end of the brace arm 21 and a second member 29 towards the shank end of the brace arm 21. The first and second members 28, 29 of each respective brace arm 21 are pivotally connected at the joint. More specifically, each of the first and second members 28, 29 has a hole 30 centred on a fourth axis of rotation E at the joint. Two studs 31 are provided, one inserted in the holes 30 of the first and second members 28, 29 of the first of the brace arms 21 and another inserted in the holes 30 of the first and second members 28, 29 of the second of the brace arms 21. The studs 31 rotate in the holes 30 to allow the first and second members 28, 29 of each respective brace arm 21 to rotate relative to one another, and hence the brace 20 to articulate at the fourth axis of rotation E.

The first, second, third and fourth axes of rotation A, C, D, E are all parallel with one another. This means that the shank 3, fluke 2 and brace 20 all rotate with respect to one another in a single plane.

It will be appreciated that pivoting the shank 3 towards the bill 17 of the fluke 2 increases the distance from the head 18 of the fluke 2, which is where the brace bracket 22 connects the brace 20 to the fluke 2, to where the brace 20 is connected to the shank 3. This has the effect of straightening the articulation of the brace 20, e.g. causing the respective first and second members 28, 29 of the brace arms 21 to unfold away from one another. Conversely, pivoting the shank 3 towards the head 18 of the fluke 2 decreases the distance from the head 18 of the fluke 2 to where the brace 20 is connected to the shank 3. This has the effect of bending the articulation of the brace 20, e.g. causing the respective first and second members 28, 29 of the brace arms 21 to fold towards one another.

A stop is provided to limit pivoting of the shank 3 towards the bill 17. In this embodiment, the stop comprises two stop pins 32 insertable in stop holes 33. The stop holes 33 are located on the shank arms 1, with central axes that intersect the sweep of the second members 29 of the brace arms 21. The stop holes 33 are provided in pairs, with the stop holes 33 of each pair having a common central axis parallel to the first to fourth axes of rotation A, C, D, E. With the stop pins 32 inserted in a pair of the stop holes, rotation of the second members 29 of the brace arms 21 is limited by the stop pins 32, when edges of each of the second members 29 abuts against the stop pins 32. In this embodiment, the shank 3 has three pairs of the stop holes 33 at different angles of the sweep of the second members 29. Locating the stop pins 32 in different ones of the pairs of stop holes 33 limits rotation of the second members 29 at a different angle. Consequently, the pivoting of the shank 3 towards the bill 17 of the fluke 2 is limited at a selected angle between the shank 3 and the bill 17 of the fluke 2, referred to as the fluke angle. This is known as the anchor deployment configuration. In this embodiment, the fluke angles are, by way of example, 30°, 40° and 50°. The fluke angle is important in encouraging the anchor 1 to set in the ground appropriately, and the fluke angles of the example are each appropriate for setting the anchor optimally in different types of ground.

The shank bracket 10 is located such that there is a greater portion of the profile of the fluke 2 between the shank bracket 10 and the head 18 of the fluke 2 than between the shank bracket 10 and the bill 17 of the fluke 2. This means that the shank 3 is pivotally connected to the fluke 2 with a greater profile of the fluke 2 towards the head 18 than towards the bill 17. In this embodiment, this is achieved by the shank bracket 10 being closer to the bill 17 than to the head 18. However, this is not always necessary, as the fluke 2 may be wider towards the head 18 than towards the bill 17. The effect of positioning the shank bracket 10 in this way is that, when the anchor 1 is in the ground and force is exerted along the length of the shank 3 away from the fluke 2 via the mooring line 4, the torque applied to the fluke 2 about the axis A tends to urge the bill 17 towards the shank 3 and the head 18 away from the shank 3. This means that the torque urges the shank 3 against the stop, thereby maintaining the anchor 1 in the anchor deployment configuration.

A frangible retainer is provided to limit pivoting of the shank 3 towards the head end 18 of the fluke 2. In this embodiment, the frangible retainer comprises two frangible retainer pins 34 insertable in retainer holes 35. The retainer holes 35 are located on the shank arms 11, and are provided in pairs. Each pair of retainer holes 35 is positioned to coincide with corresponding retainer holes 35 in the second members 29 of the brace arms 21, when the edges of the second members 29 abut against the stop pins 32 inserted in a respective pair of the stop holes 33. With the frangible retainer pins 34 inserted in the pair of retainer holes 35 associated with the pair of stop holes 33 in which the stop pins 32 are inserted, rotation of the shank 2 in relation to the fluke 2 is prevented.

The frangible retainer is relatively weak in comparison to the stop, and in comparison to the amount of torque normally pulling the shank 3 towards the head end 18 of the fluke 2 when the anchor 1 is being extracted from the ground. This means that the frangible retainer should usually shear during extraction of the anchor 1 from the ground, thereby allowing the shank 3 to rotate towards the head end 18 of the fluke 2.

Figure 3:
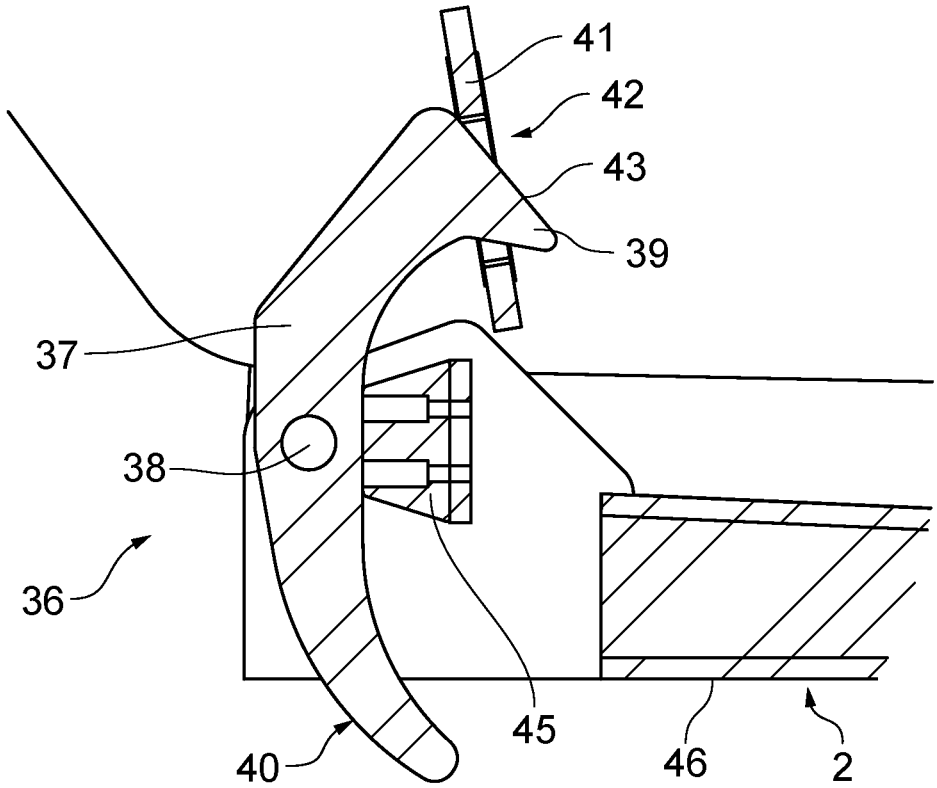
FIG. 3 is a cross-sectional view of a fastener of the anchor.

With the frangible retainer sheared, pivoting of the shank 3 towards the head end 18 of the fluke 2 is limited by the shank 2 coming to rest against the first surface 13 of the fluke 2. A fastener 36 is provided at the head end 18 of the fluke 2 to retain the shank 2 in this position, which is known as the anchor retrieval configuration. As can be seen most clearly in FIG. 3, the fastener 36 comprises a rocker arm 37 mounted on a pivot 38. At one end of the rocker arm 37 there is a protrusion 39. At the other end of the rocker arm 37 there is an actuator 40. A resilient member 45 is provided adjacent to the pivot 38, resting against a surface of the rocker arm 37 on both sides of the pivot 38, such that the rocker arm 37 is resiliently held in a first orientation. In this embodiment, the pivot 38 provides the rocker arm 37 with a single axis of rotation parallel to the first to fourth axes of rotation A, C, D, E, and, in the first orientation, the rocker arm 37 is substantially perpendicular to the axis of symmetry B of the fluke 2. Rotation of the rocker arm 37 about the pivot 38 in either direction is against the force of the resilient member 45. In this embodiment, the resilient member 45 is a block of elastically deformable material, such as rubber.

The shank 3 has a bar 41 arranged to come into contact with the fastener 36 as the shank 3 rotates towards the head end 18 of the fluke 2. In this embodiment, the bar 41 extends between the shank arms 11. The bar 41 has a fastener hole 42 arranged to receive the protrusion 39 when the shank 3 rests against the first surface 13 of the fluke 2, to retain the shank 3 is the anchor retrieval configuration. The fastener 36 has a cam surface 43. The bar 41 is arranged to come into contact with the fastener 36 at the cam surface 43 as the shank 3 rotates towards the head end 18 of the fluke 2 and the rocker arm 37 is in the first orientation. So, the bar 41 is effectively a cam follower. The bar 41 is arranged to cooperate with the cam surface 43 to push the protrusion 39 away from the bar 41, that is away from the shank 3, as the shank 3 rotates towards the head end 18 of the fluke 2. As the shank 3 comes to rest against the first surface 13 of the fluke 2, the bar 41 is arranged to slide off the cam surface 43 and the protrusion 39 can move into the fastener hole 42 under the biasing force of the resilient member 45. With the shank 3 resting against the first surface 13 of the fluke 2 and the rocker arm 37 in the first orientation, the protrusion 39 is located in the fastener hole 42, and the fastener 36 thereby retains the shank 3 in the anchor retrieval configuration. The action of the rocker arm 37, under the influence of the bar 41, fastener hole 42 and resilient member 45, as the shank 3 rotates towards the head end 18 of the fluke mean that, in this embodiment, the fastener 36 is effectively a catch.

The actuator 40, located at the opposite end of the rocker arm 37 to the protrusion 39, is arranged to protrude beyond a second surface 46 of the fluke 2, on the opposite side of the fluke 2 to the first surface 13. It will be appreciated, therefore, that the rocker arm 37 extends across the thickness of the fluke 2, from one side of the fluke 2 to the opposite side of the fluke 13, at the head end 18. The actuator 40 is arranged such that moving the actuator 40 away from the head end 18 of the fluke 2 causes the protrusion 39, located at the other end of the rocker arm 37, to move away from the bar 41, that is away from the shank 3. This means that the actuator 40 can be used to move the protrusion 39 out of the fastener hole 42, thereby releasing the shank 3 from the anchor retrieval configuration.

Figure 4:
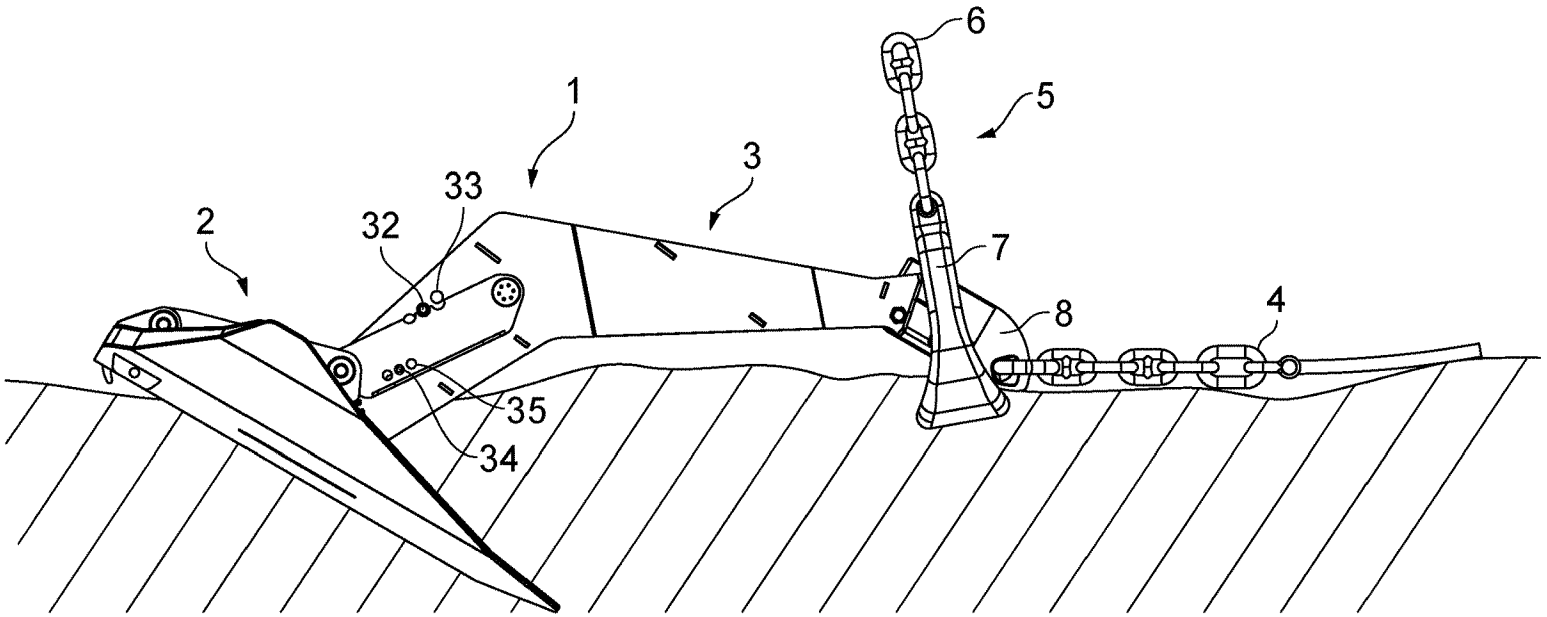
FIG. 4 is a side view of the anchor set in the ground.

In operation, the anchor 1 is put in the anchor deployment configuration whilst aboard the AHTS vessel. This involves inserting the stop pins 32 in a pair of the stop holes 33 to select a fluke angle between the shank 3 and the fluke 2, and inserting the frangible retainer pins 34 in the pair of retainer holes 35 associated with the selected stop holes 33. The anchor 1 is then released into the water by the AHTS vessel and set into the ground, under control of the AHTS vessel. As shown in FIG. 4, with the anchor 1 set, the bill 17 of the fluke 2 penetrates the ground to hold the anchor 1 in place. When force is applied to the anchor 1 via the mooring line 4 in the direction of the length of the shank 3, the location of the axis A ensures that the torque applied to the shank 3 by the fluke 2 urges the shank 3 towards the bill 17 of the fluke 2. This causes the brace arms 21 to push against the stop pins 32, which ensures that the anchor 1 remains in the anchor deployment configuration.

Figure 5:
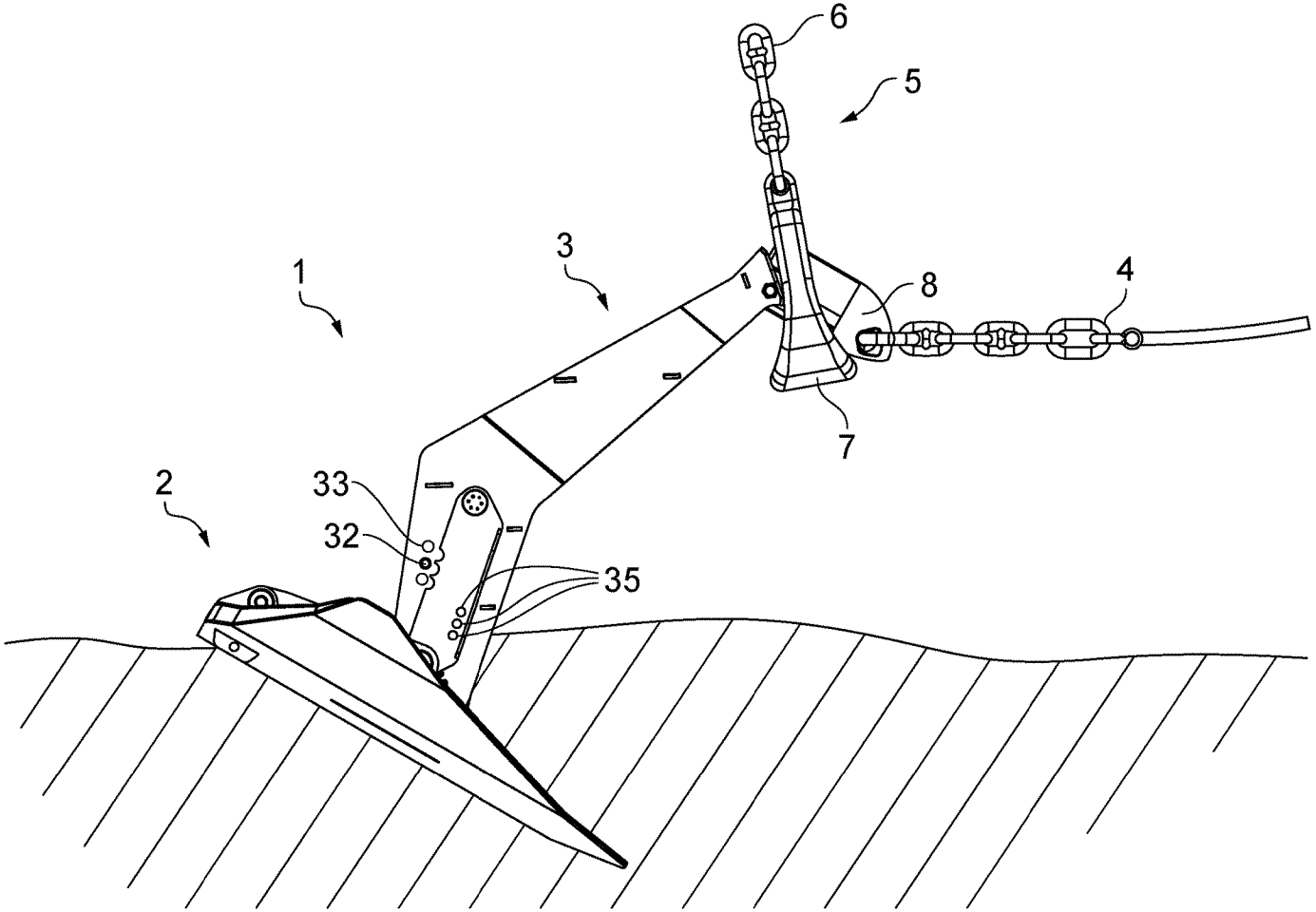
FIG. 5 is a side view of the anchor at a first stage of retrieval, just beginning to be pulled out of the ground.
Figure 6:
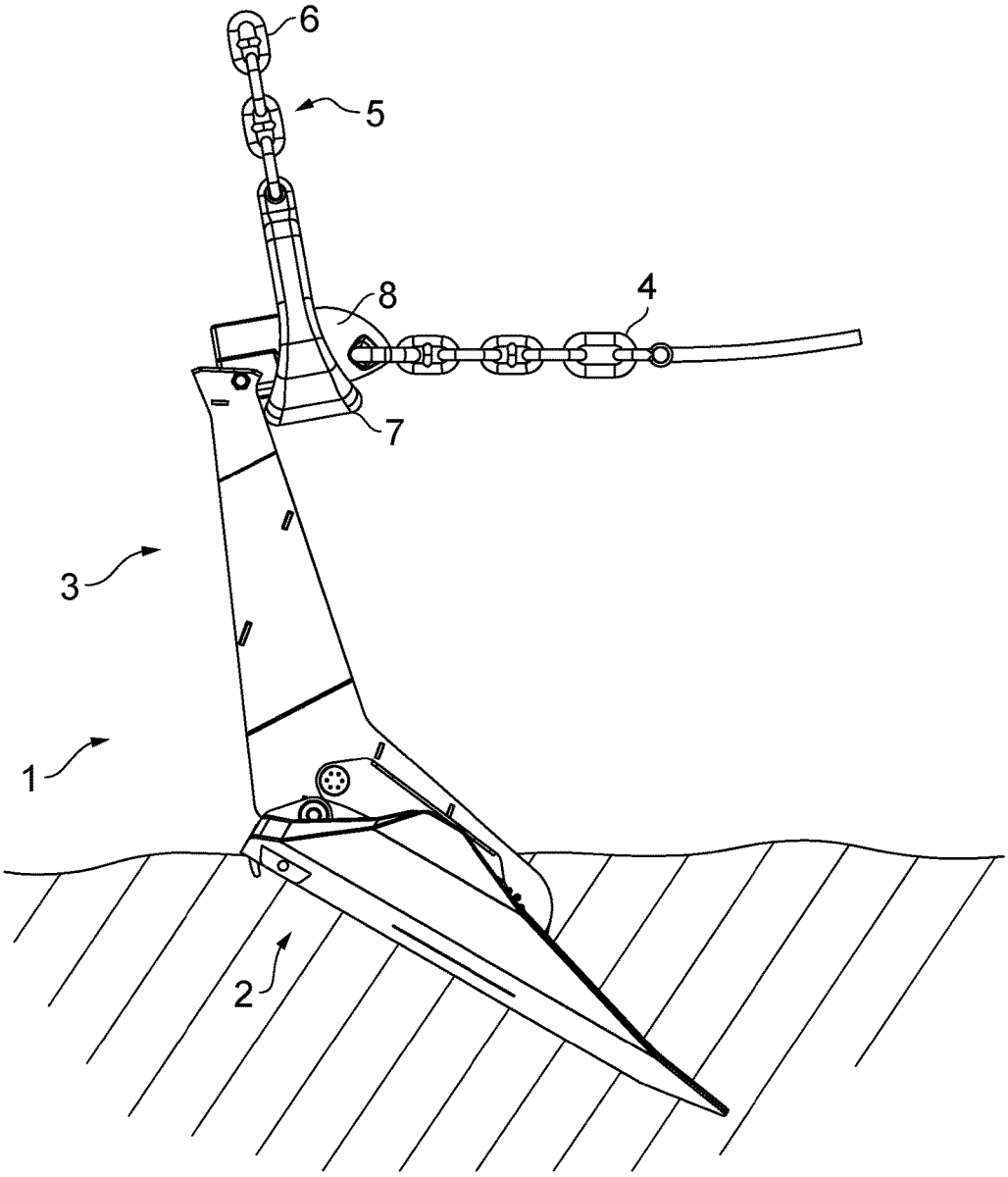
FIG. 6 is a side view of the anchor at a second stage of retrieval, continuing to be pulled out of the ground.

When it is desired to retrieve the anchor 1, the AHTS vessel travels along the direction of the mooring line 4 towards the anchor 1, dragging the chasing collar 7 along the mooring line 4. Travel of the chasing collar 7 is stopped by the shackle 8 and force is then exerted on the anchor 1 via shackle 8. This force urges the shank 3 towards the head 18 of the fluke 2, which causes the brace arms 21 to push against the frangible retainer pins 34. Enough force is exerted to break the frangible retainer pins 34 to release the anchor 1 from the anchor deployment configuration. Typically, this force might 250 N. The shank 3 is then free to rotate relative to the fluke 2, as shown in FIG. 5, towards the head end 18 of the fluke 2, into the anchor retrieval configuration, as shown in FIG. 6. As the shank 3 is rotated into the anchor retrieval configuration, the fastener 36 acts to retain the shank 3.

When the shank 3 is in the anchor retrieval configuration, the AHTS vessel continues to exert force on the anchor 1, which force may be up to in the region of 1500 N, to pull the fluke 2 out of the ground. It can be seen that the orientation of the shank 3 relative to the fluke 2 in the anchor retrieval configuration means that the retrieval force is directed to pull the fluke 2 up and out of the ground with minimal torque being applied to the anchor 1.

Figure 7:
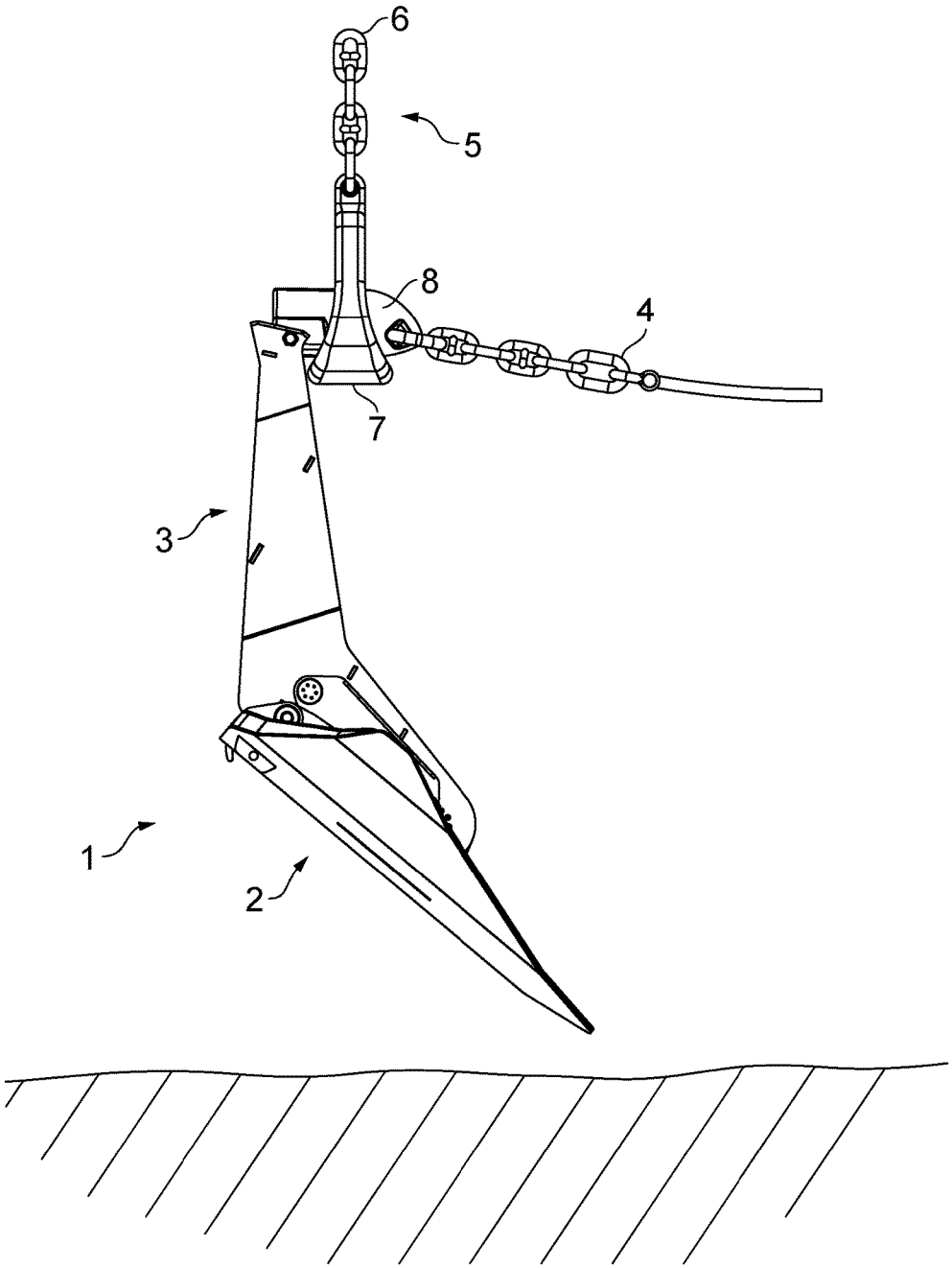
FIG. 7 is a side view of the anchor at a third stage of retrieval, clear of the ground and being pulled back to a vessel for stowage.

FIG. 7 is a side view of the anchor at a third stage of retrieval, clear of the ground and being pulled back to a vessel for stowage.

Figure 8:
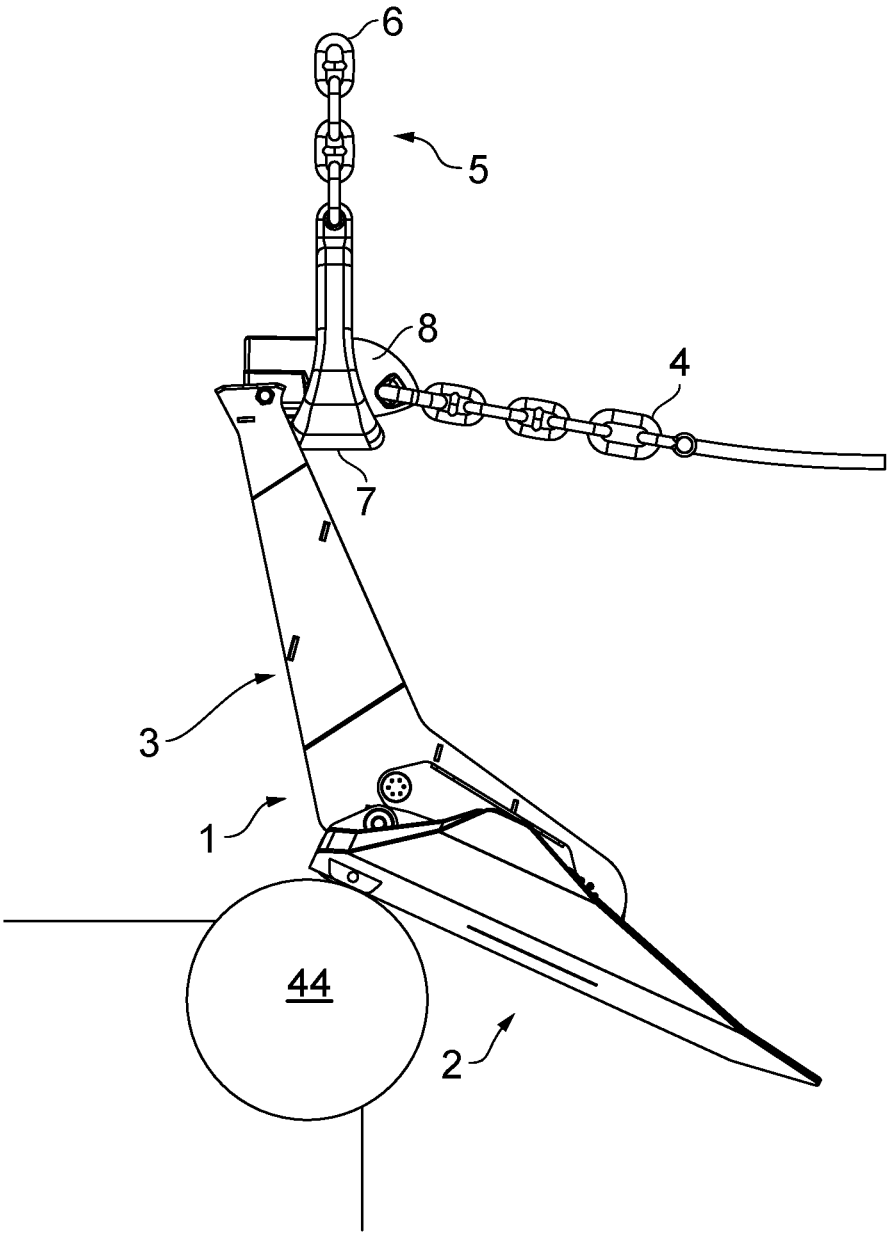
FIG. 8 is a side view of the anchor at a fourth stage of retrieval, as it is pulled onto an anchor handling tug supply vessel.
Figure 9:
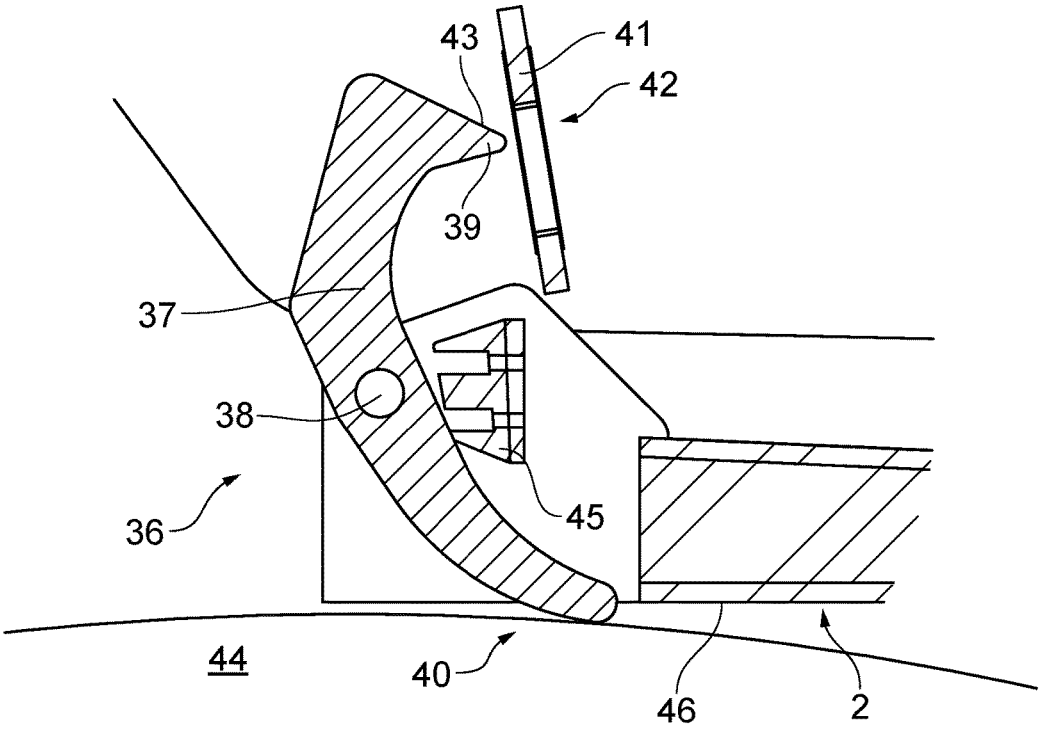
FIG. 9 is a cross-sectional view of the fastener of the anchor at the fourth stage of retrieval.

As the anchor 1 is retrieved onto the AHTS vessel, it typically passes over a roller 44 on the side of the vessel, as shown in FIG. 8. Due to the orientation of the shank 3 and fluke 2 in the anchor retrieval configuration, and the positioning of the chasing line 6 and mooring line 4 relative to the roller 44 as the anchor 1 is retrieved, it is usually the second surface 46 of the fluke 2 that is effectively the "bottom" of the anchor 1 at this stage and therefore passes against the roller 44. This means that the actuator 40 of the fastener 36 is pushed away from the head end 18 of the fluke 3 as the anchor 1 passes over the roller 44. This causes the rocker arm 37 to rotate against the force of the resilient member 45, and the protrusion 39 to move out of the fastener hole 42, as shown in FIG. 9. This releases the shank 3 from the anchor retrieval configuration and allows the anchor 1 to be returned to the anchor deployment configuration, ready for the anchor 1 to be deployed again once new frangible retaining pins 34 have been inserted into the retaining holes 35. The rotation of the rocker arm 37 also causes the actuator 40 to move towards the second surface 46 of the fluke 2, thereby allowing the anchor 1 to pass over the roller 44.

Various modifications may be made to the embodiments described above. For example, the fluke 2 may have a different shape. In particular, the fluke 2 may have only one tip 19 at the bill 17.

The shank 3 described above has two shank arms 11, but this is not essential. The shank 2 may alternatively have a single shank arm 11. Likewise, the brace 20 described above has two brace arms 21, and this is not essential. The brace 20 may have a single brace arm 21, regardless of whether or not the shank has one or two shank arms 11. Naturally, the shank bracket 10, brace bracket 22 and the connection between the shank 3 and the brace 20 can be modified accordingly.

It should also be noted that the anchor 1 can be used with just a single frangible retaining pin 34, without any other modification, if it is desired to retain the anchor 1 in the anchor deployment configuration more weakly, or if a stronger material is used for the frangible retaining pin 34.

As described above, once the shank 3 is released from the anchor retrieval configuration, the anchor 1 may be returned to the anchor deployment configuration, ready for the anchor 1 to be deployed again.

In some arrangements, a return member (not shown) that is operable to cause the shank to pivot away from its position in the anchor retrieval configuration may be provided. The return member may be implemented in different forms. In one arrangement, the return member may be an actuator mounted on the anchor 1 and operable to apply a force to the shank causing the shank to pivot away from the anchor retrieval configuration. The actuator may be operated in any way selected by a skilled person, for example electrically, hydraulically, or pneumatically.

In some arrangements, a biasing member that biases the shank to pivot away from the anchor retrieval configuration may be provided. The biasing member may therefore act as the return member. The biasing member may be arranged on the anchor 1 biasing the shank 3 to pivot away from the fluke 2 towards the shank position in the anchor deployment configuration.

The biasing member may be implemented in a number of different ways. In one embodiment, the biasing member may be arranged to apply a biasing force or torque in a direction pivoting the shank 3 in the direction from the head 18 of the fluke 2 towards the bill 17 of the fluke 2. The biasing member may be a torsion member, formed by a torsion spring, or by a wire-form torsion element, or by a resilient torsion element, for example. The torsion member may be arranged between the shank arms 11 and shank supports 12 to provide a torque to the shank arms. Alternatively, the biasing member may be provided by a tension spring or compression spring disposed between the shank 3 and the fluke 2.

In some arrangements, the force applied by the return member or biasing member may be sufficiently strong to cause the shank 3 to pivot to its position in the anchor deployment configuration with no or with only minimal external force being applied to the shank 3. In other arrangements, the force applied by the return member or the biasing member may not be sufficiently strong to cause the shank 3 to pivot completely from its position in the anchor retrieval configuration to its position in the anchor deployment configuration without external assistance. In either case, once the anchor has been returned to the anchor deployment configuration, new frangible retaining pins 34 may be inserted into retaining holes 35, ready for the anchor to be deployed again.

Other variations and modifications will be apparent to the skilled person. Such variations and modifications may involve equivalent and other features that are already known and which may be used instead of, or in addition to, features described herein. Features that are described in the context of separate embodiments may be provided in combination in a single embodiment. Conversely, features that are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present invention.

The invention claimed is:

1. An anchor comprising:

a fluke having a head, and a bill for penetrating the ground;

a shank pivotally connected to the fluke so as to be pivotable between an anchor deployment configuration and an anchor retrieval configuration, wherein the shank pivots away from the bill towards the head into the anchor retrieval position; and a fastener arranged to engage with the shank to retain the shank in the anchor retrieval configuration.

2. The anchor of claim 1, wherein the fastener is a catch.

3. The anchor of claim 1, wherein the fastener has a projection that extends over a lip of the shank to engage with the shank to retain the shank in the anchor retrieval configuration.

4. The anchor of claim 1, wherein the fastener is biased towards engagement with the shank.

5. The anchor of claim 4, wherein the fastener has a cam surface, the shank has a cam follower, and the cam follower is arranged to cooperate with the cam surface as the shank pivots to the anchor retrieval configuration so as to push the fastener against the biasing until the fastener engages with the shank.

6. The anchor of claim 1, wherein the fastener has an actuator that is moveable to release the fastener from engagement with the shank to allow the shank to pivot to the anchor deployment configuration.

7. The anchor of claim 6, wherein the actuator protrudes from a surface of the fluke and is operable where it protrudes to release the fastener from engagement with the shank.

8. The anchor of claim 7, wherein the actuator is operable to release the fastener from engagement with the shank by being moved towards the surface.

9. The anchor of claim 8, wherein the actuator is biased away from the surface.

10. The anchor of claim 6, wherein the actuator is on the opposite side of the fluke to the shank.

11. The anchor of claim 6, wherein the fastener comprises a rocker arm, the engagement of the fastener with the shank occurs at one end of the rocker arm and the actuator is the other end of the rocker arm.

12. The anchor of claim 1, wherein the fluke has a head and a bill, and the shank is pivotally connected to the fluke around an axis located such that more of the profile of the fluke is between the axis and the head than between the axis and the bill.

13. The anchor of claim 1, comprising a brace that restricts pivoting of the shank to provide the anchor deployment configuration.

14. The anchor of claim 13, wherein the brace is moveable between a bracing position when the anchor is in the anchor deployment configuration and a stowed position when the anchor is in the anchor retrieval configuration.

15. The anchor of claim 14, wherein the brace is pivotally connected at one end to the fluke and pivotally connected at the other end to the shank, and the brace is articulated so as to fold between the bracing position and the stowed position.

16. The anchor of claim 14, wherein the brace is retained in the bracing position by a frangible retainer.

17. The anchor of claim 1, wherein the anchor has two or more different anchor deployment configurations, the shank being oriented at a different angle to the fluke in each of the anchor deployment configurations.

18. The anchor of claim 14, comprising a stop against which the brace rests in the bracing position, which stop can be positioned in one of at least two different locations, each different location providing a different bracing position, each different bracing position causing the shank to be oriented at a different angle to the fluke in the anchor deployment configuration.

19. The anchor of claim 1, comprising a return member operable to cause the shank to pivot away from the anchor retrieval configuration.

20. The anchor of claim 1, comprising a biasing member that biases the shank to pivot away from the anchor retrieval configuration.

* * * * *